United States Patent [19]

McCay et al.

[11] Patent Number: 4,506,575

[45] Date of Patent: Mar. 26, 1985

[54] CORE SLABBER

[75] Inventors: Johnny A. McCay, Hartselle; Arthur H. Owens, Florence; Jeffrey S. Pfaffman, Decatur, all of Ala.

[73] Assignee: Champion International Corporation, Stamford, Conn.

[21] Appl. No.: 526,660

[22] Filed: Aug. 26, 1983

[51] Int. Cl.[3] ..... B26D 3/00

[52] U.S. Cl. ..... 83/368; 83/451; 83/614; 83/924; 269/48.1

[58] Field of Search ..... 83/180, 613, 614, 924, 83/368, 451; 269/48.1

[56] References Cited

U.S. PATENT DOCUMENTS

| | | | |
|---|---|---|---|
| 1,838,011 | 12/1931 | Peter | 83/924 X |
| 3,204,501 | 9/1965 | Lane | 83/924 X |
| 3,245,302 | 4/1966 | Bayley | 83/924 X |
| 3,851,552 | 12/1974 | English et al. | 83/180 X |

*Primary Examiner*—James M. Meister

*Attorney, Agent, or Firm*—Evelyn M. Sommer

[57] ABSTRACT

A core slabber for removing paper from the cores of fiberboard rolls where the cores are to be reused comprising a horizontal core support, a clamp plate on the core support, a camshaft internally of the core support to move a pin outwardly radially from said core support to move said clamp outwardly to engage the interior of the core. Tracks parallel to the axis of said core support carry a cutting blade on a blade carrier. A mechanism for moving said cutting blade accurately into engagement with selected depths of outer layers of paper on the core in order to cut the paper several layers at each pass in order to remove the paper and prepare the core for reuse. A sensor is also provided to limit the movement of the blade toward the core and also to limit and reverse the traverse of the blade parallel to the axis of the core.

10 Claims, 5 Drawing Figures

4
4

CORE SLABBER

The present invention relates to a device known as a Core Slabber and is to be used primarily to remove the last remnants of paper from fiberboard rolls that are to be reused. Such fiberboard rolls are generally referred to as cores.

BACKGROUND OF nTHE INVENTION

In various operations, including the making of paper such as corrugated board or the utilization of paper such as in printing presses, large mill rolls are utilized weighing a ton or more and having a lateral dimension and hence a core which may be as much as 96 inches in length and even more. When the mill roll is nearing the end of its run in a continuously operating machine, the splicing on the fly of the leading end of the next roll to the trailing end of the roll which is being used up normally results in several layers of paper being left on the core. While some of the outer plys of the paper on the roll are free or loose and may readily be pulled off, the inner layers may adhere to the core either by reason of the manner in which the edge of the paper at the core has been initially secured to the core or because of lengthy storage. Since the very long core is constructed to support a heavy mill roll and is often utilized in a structure wherein the core is supported not by a continuous shaft within it, but by plugs at the ends, the core itself is an expensive structure and designed to be reused, not merely thrown away.

Because of the size of the core and the number of layers of paper which may still remain thereon or even adhere thereto, removing of the remaining layers of paper from the core and making available the original surface so that a new mill roll may be wound thereon is a difficult task if performed manually and is not always performed thoroughly.

SUMMARY OF THE INVENTION

The present invention has for its object the provision of a Core Slabber or device for removing the remaining plies of paper on the core by a simplified means which include a cantilevered support for the core, means for securing the core to the said cantilevered support and a controlled blade or cutting device which will successively cut through the layers of paper on the core, slabbing the paper and permitting it to either fall off or placing it in such condition that, upon removal of the core from the device, the paper may readily be pushed off by hand.

A more specific object of the present invention is the arrangement of a core slabber or a device for removing remaining paper from a mill roll core wherein the core is mounted cantilever in a substantially horizontal direction and is securely fixed by a cammed expansion plate on the mounting device. The outer surface of the paper plies or layers on the core are transversed by a blade moving parallel to the axis of the core and spaced from the core as well as movable toward the core on successive passes to accurately cut the layers either layer by layer or in groups of layers while maintaining such control that the core itself is not raked or razed or cut by the blade.

BRIEF DESCRIPTION OF THE DRAWINGS

The foregoing and many other objects of the present invention will become apparent in the folllowing description and drawings in which.

DETAILED DESCRIPTION OF THE INVENTION

Figure 1:
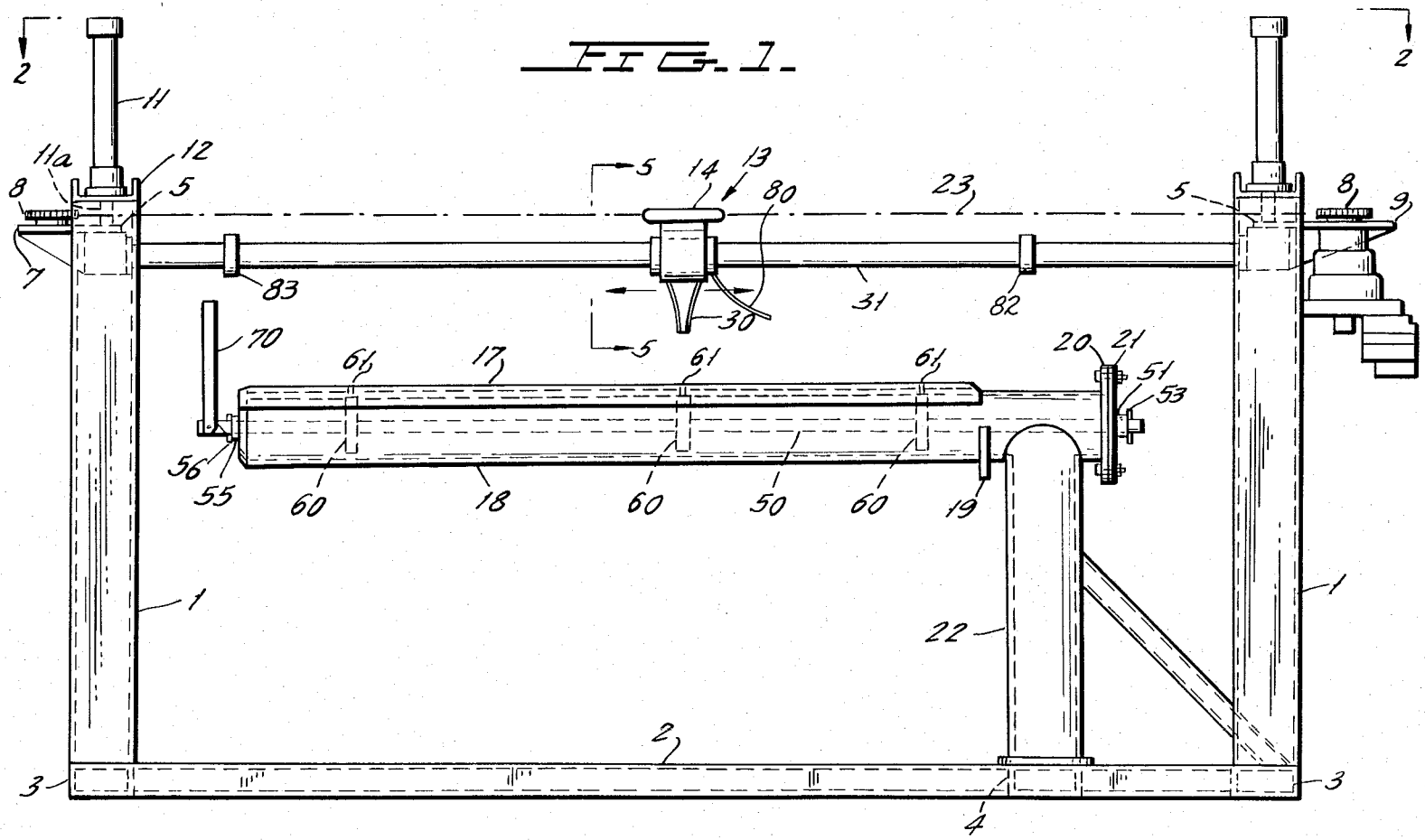
FIG. 1 is a side elevation of the novel device of the present invention showing a blade positioned above the core carrier and arranged to be lowered toward the core carrier as well as arranged to transverse a path parallel to the axis of the core carrier.

Referring to the figures, the core slabber of the present invention is supported by a frame having bottom sections 2, 2 and vertical support sections 1, 1. The bottom sections 2 and the vertical support sections 1 may be integrated in any suitable manner to rigidify the frame as a whole and provide the upstanding supports 1 which may if desired be cross braced or otherwise supported to create a rigid structure. The vertical frame sections on each end as shown in Figure 2 support the carriage carrying frame structure 5 between them at each end of the device. Immediately above the carriage carrying frame 5 is positioned a cross frame member 12 which interconnect the upper ends of the frame vertical members 1 at each end of the structure in Figures 1 and 2. A hydraulic cyliner 11 at each corner of the machine is carried by cros frame member 12. The ram 11*a* of each hydraulic cylinder 11 is connected to the carriage carrying frame 5. Thus the carriage carrying frame 5 is supported by the ram 11*a* of the hydraulic cylinder 11.

Figures 3, 4, 5:
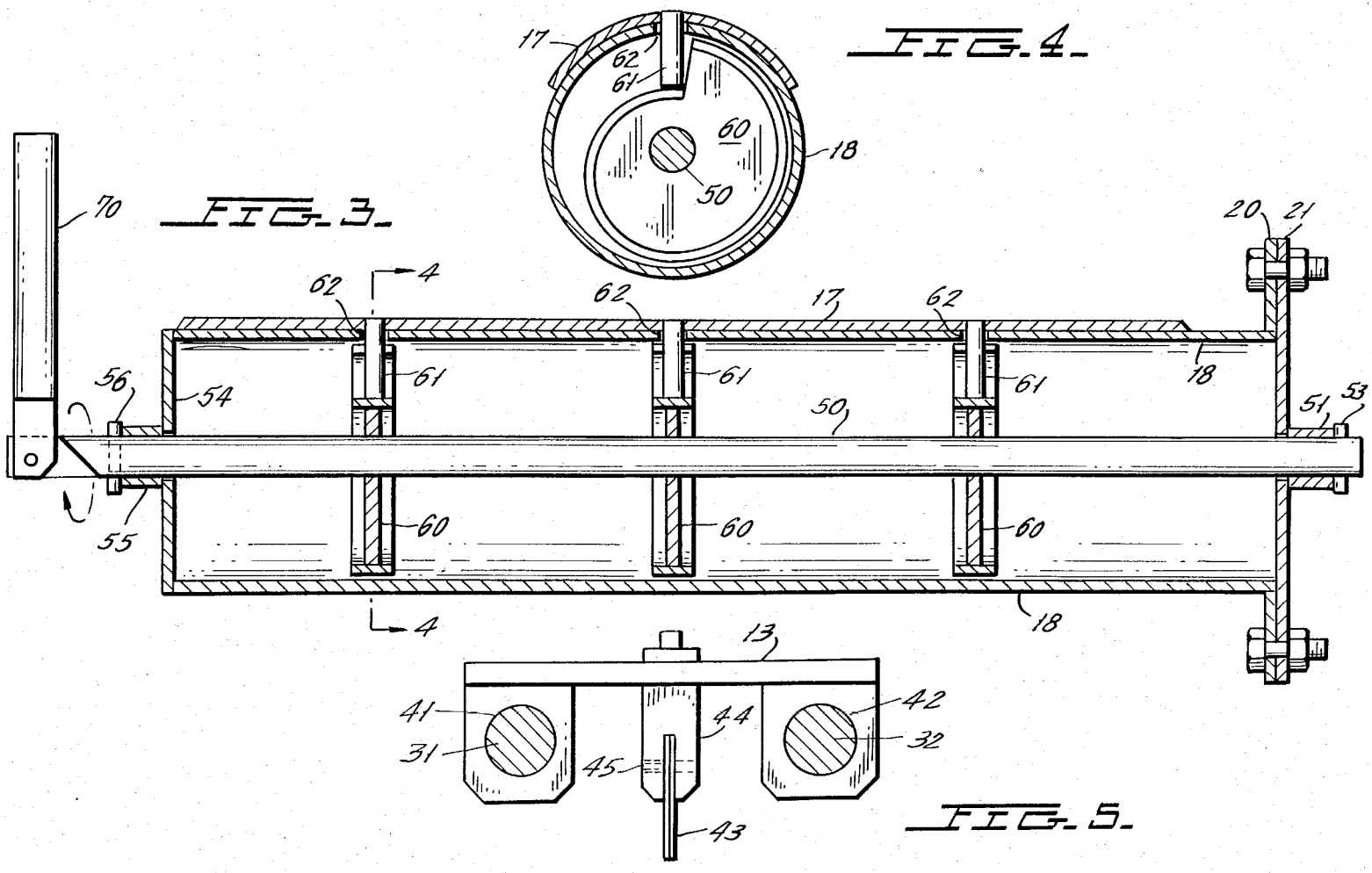
FIG. 3 is a cross-sectional view through the core carrier section of the device of FIGS. 1 and 2 taken on line 3—3 of FIG. 2.
FIG. 4 is a cross-sectional view of the core carrier taken on line 4—4 of FIG. 3 looking in the direction of the FIG. 5 is a view partly in cross-section showing the blade carrier and its support taken from line 5—5 of FIG. 1 looking in the direction of the arrows.

A carriage 13 for the blade 30 rides on the rails 31, 32 between the opposite carriage carrying frames 5. The carrier 13 as seen particularly in FIG. 5 is provided with slides 41, 42 at opposite sides of the carriage 13 with appropriate openings to engage the rails 31, 32. The center of the carriage 13 carries the blade 30 secured to blade support 44 by any suitable means such as the set screw 45. The length of the blade and the type of blade used may, for appropriate cases, be selected by changing the blades 30 when needed. However, for any successive series of operations on successive cores including a sharpening in place, the same blade may be used for all purposes.

The sprocket chain 14 is supported on oppposite sprockets 8 carried by the drive base 7, 9 on each side supported on the carriage carrying frame 5 on each side. The sprockets 8 are horizontal as shown and the sprocket path and return are in a horizontal plane whereby the blade overlies exactly the tube 18 which is to carry the core and the return of the sprocket 8 is out of the path of the blade 30. The hydraulic cylinder 11 at each corner supports the carriage carrying frame 5 and may be adjusted so that the spacing of the blade with respect to the axis of the tube 18 may be adjusted, visually or in response to limit switch or feeler devices which control the operation of the hydraulic cylinders 11.

Figure 2:
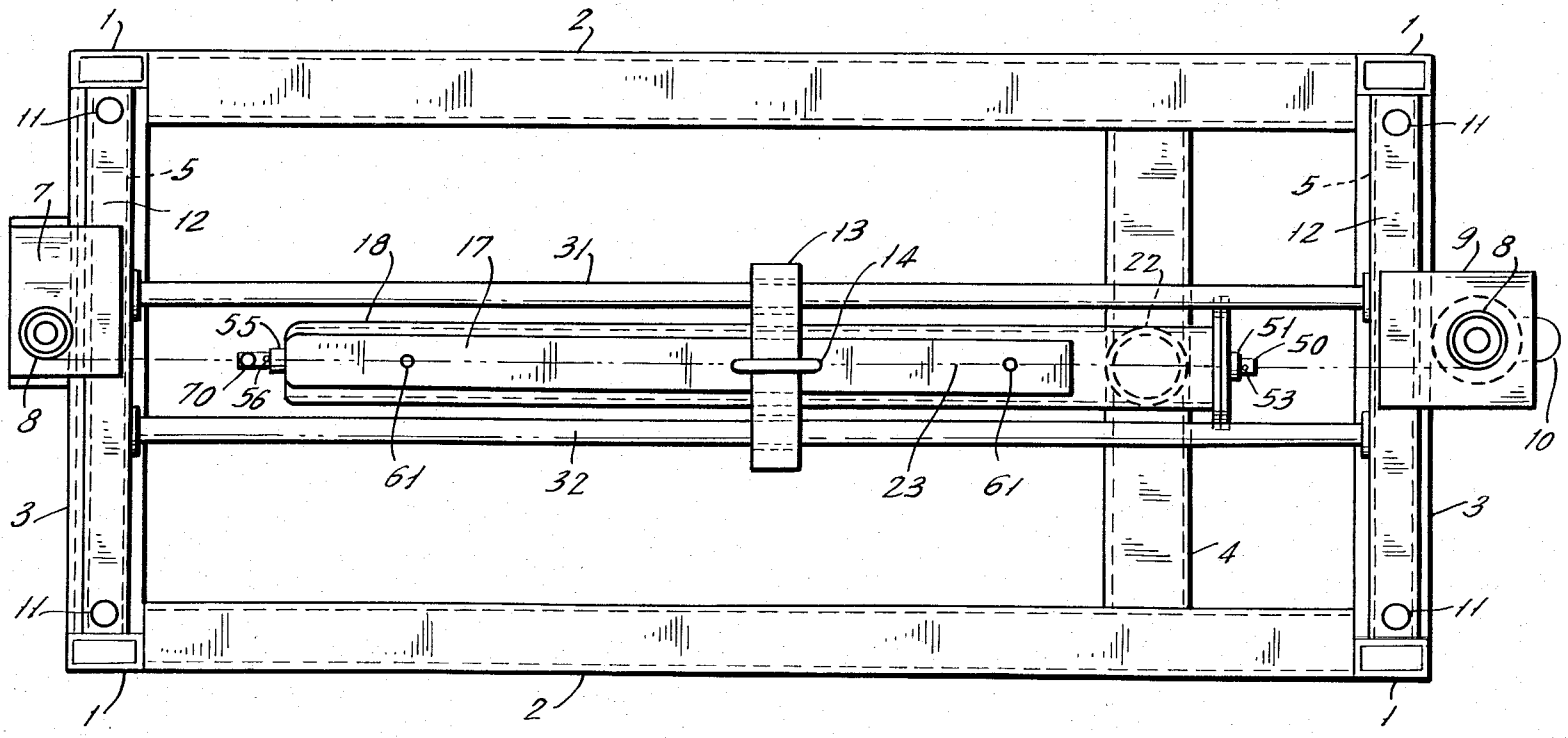
FIG. 2 is a top plan view of the core slabber taken on line 2—2 of FIG. 1 looking in the direction of the arrows.

The right hand sprocket 8 is supported on a drive base 9 on the right side of FIG. 1 and is in turn connected to the drive unit 10 which may be an electric motor or any other suitable device for driving the right hand sprocket 8. The left hand or idler sprocket 8 is supported on an idler base 7 on the carriage carrier 5 at the left side of the structure.

A tube stem 22 forming a pillar supports the horizontal tube 18 which extends longitudinally, parallel to the path of travel of the carriage 13 and the rails 31, 32. Appropriate flanges 20, 21 at the right-hand end of the tube provide a closure for the end and a support for the cam shaft 50. Flanges 20, 21 secured together at the right-hand end of the tube 18 support the sleeve 51 in which the right end of the cam shaft 50 rotates. The right end of the cam shaft 50 is fixed against longitudinal movement to the left of the camshaft 50 with respect to FIG. 3. The opposite end of the tube 18 is closed and rigidified by the closure member 54 carrying the sleeve 55. Dowel 56 passing through the camshaft 50 prevents movement of the camshaft 50 to the right with respect to FIG. 3. Hence, camshaft 50 may rotate freely in the sleeves 51 and 55, but may not move longitudinally with respect thereto.

Camshaft 50 carries the cams 60 so arranged that the outer surface thereof bears against the pins 61 which pass through corresponding openings 62 in the tube 18 and are connected to the locking plate 17. The crank 70 is hingedly secured to the camshaft 50 at the hinge 71 so that it may be rotated from a position coaxial with the camshaft 50 to a position in cranking relation with the camshaft 50.

In operation, before a core is placed on the machine in order to remove the excess paper, the crank 70 is rotated to a horizontal position coaxial with the camshaft 50. The core is slipped on the tube 18 over the tube lock plate 17. For this purpose, the camshaft 50 and the cams 60 must be in the position shown in FIG. 4 with the lock plate 17 against the surface of the tube 18. A roll stop pin 19 is provided to the tube 18 to limit the movement of the core with respect to the tube 18 and position it correctly. The cam handle 70 is then rotated to the crank position shown in FIG. 3, and the camshaft is rotated thereby rotating the cams 60 and lifting the pins 61 through the openings 62 in tube 18. This lifts the locking plate 17 inside the core which is placed on the machine to enage the inner surface of the core. Where desired, appropriate means such as rachet means or paul and detent means may be utilized to hold the crank handle 70 or the crank shaft 50 in the locked position. In practice, the camshaft 50 may be a sufficiently tight fit in the sleeves 51 and 55 so that such additional locking means may not be necessary. The hydraulic cylinders 11 are operated to drive the carriage carrying frame 5 down until the end of the blade 30 contacts the outer sheets on the core. The drive unit 10 is then started and the carriage 13 will move to the end of the core, cutting the paper on the core. Thereafter the movement of the carriage is reversed and then reversed again to cut successive layers of paper from the core with the hydraulic cylinder 11 moving down by a predetermined amount between successive passes of the blade 30.

Various means may be provided to control the operation and protect the core. Thus, for instance, a feeler 80 may be provided on the carriage so adjusted that it will shut off the operation of the hydraulic clyinders 11 at a predetermined distance as the blade enters the remaining paper on the core. The feeler 80 may be appropriately adjusted so that it will operate to shut off the downward travel of the carriage 13 after the blade has penetrated a distance equal to one, two or three layers. This will ensure that in the event of inattention by the operator, the blade will not penetrate so far as to damage the core. After the descent of the carriage 13 has been stopped either by the operator or by the feeler 80, the drive unit 10 may be turned on by the operator.

The drive unit will have appropriate reversing means so that the carriage 13 may move back and forth. The carriage blade 30 may be arranged to cut only on a pass in one direction or may be double-edged to cut on a pass in both directions. In any event, limit switches 82, 83 may be provided, appropriately located as for instance on one of the tracks 31 for the carriage 13 to cut off the supply of energy to the drive unit 10 at the end of the travel of the carriage 13 just beyond the end of the core on the support tube 18. The switches 82, 83 may also be reversing switches to position the motor so that it will drive the carriage in a direction opposite to that it travelled when it first engaged the switch. Other control and limit means may be provided.

By this means therefore a simplified means is provided for quickly slabbing a core, that is removing the remaining paper on the core. Since many variations and modifications of the present invention will now be obvious to thos skilled in the art, it is preferred that the scope of the present invention be determined not by the specific disclosures herein contained, but only by the appended claims.

What is claimed:

1. A core slabbing device for removing the remaining layers of paper on the core of a mill roll, said core slabbing device comprising: a core carrier dimensioned to fit within and bear against the internal surface of the core; locking means for integrating the core with the core carrier; a blade carriage carrier aligned parallel to said core carrier and movable toward and away from said core carrier; a blade carriage slidably mounted on said blade carriage carrier for movement parallel to the axis of the core and the core carrier; a blade on said blade carriage; means for moving said blade carriage carrier toward and away from said core carrier; means for sensing and controlling the amount of amount of movement of the blade carriage carrier toward said core; and means for driving said blade carriage in a direction parallel to said core with the blade engaged with preselected layers of paper on said core to cut through said preselected layers on said core thereby enabling the removal of the paper.

2. The core slabber of claim 1 wherein said blade carriage carrier comprises a pair of parallel rails; and openings in said blade carriage registering with said rails to guide said blade carriage accurately with respect to the axis of said core.

3. The core slabber of claim 2 wherein clamping means are provided for securing the core on said core support.

4. The core slabber of claim 3 wherein said clamping means comprise a clamping plate exteriorly of said core support; said clamping plate being movable radially outwardly to engage the interior of a core on said core support.

5. The core slabber of claim 4 wherein means are provided for moving said clamping plate outwardly said means comprising a camshaft within said core support, cam members in said core support and cam operated cam follower engaging the surface of said cam members, said cam followers extending through openings in said core support and a plate on said core support supported by said pins.

6. The core slabber of claim 5 wherein rotation of said cams results in radial movement of said cam followers radially outwardly from said core support to cause said clamp plate to engage the interior of a core mounted on said core support.

7. The core slabber of claim 4 wherein limiting means are provided for the movement of said blade carrier in each direction to halt said blade carriage as the blade leaves the core mounted on said core support.

8. The core slabber of claim 4 wherein said core support is supported cantilever fashion with respect to said rails carrying said blade carriage, a crank for operating the shaft in said core support which carries said cams, said crank being rotatable from a loading position coaxial with said shaft to permit the core to be placed on said core support and rotatable to a crank position substantially normal to said shaft to rotate said shaft to operate said cams.

9. A core slabber as in claim 1 wherein the means for sensing and controlling the amount of movement of the blade carriage carrier toward said core comprises a feeler mounted to said blade carriage and positioned to be in contact with the outer layer of paper when the blade has penetrated the paper a preselected amount and to stop the movement of the blade carriage carrier towards the core after the preselected penetration of said blade into said layers of paper on said core.

10. A core slabbing device for removing layers of paper remaining on a hollow cylindrical core of a mill roll, said core slabbing device comprising:

a core carrier dimensioned to fit within the core;

a cam shaft rotationally mounted within said core carrier;

at least one cam member mounted to said cam shaft;

a cam follower mounted to said cam member;

a clamping plate disposed exteriorly of said core carrier and mounted to said cam follower, said clamping plate being movable radially outwardly from said core carrier;

a blade carriage carrier aligned parallel to said core carrier and moveable toward and away from said core carrier;

a blade carriage slidably mounted on said blade carriage carrier for movement parallel to the axis of the core carrier;

a blade mounted to said blade carriage; and means for moving said blade carriage carrier toward and away from said core carrier, whereby rotation of said cam shaft causes radial movement of said clamping plate and enables secure mounting of the core to the core carrier and clamping plate, thereby allowing the blade and blade carriage to be positioned and moved relative to the core for removal of the remaining layers of paper thereon.

* * * * *

UNITED STATES PATENT AND TRADEMARK OFFICE

CERTIFICATE OF CORRECTION

PATENT NO. : 4,506,575

DATED : March 26, 1985

INVENTOR(S) : Johnny A. McCay, Arthur H. Owens, Jeffrey S. Daffman

It is certified that error appears in the above—identified patent and that said Letters Patent is hereby corrected as shown below:

In the Title Background of The Invention, Column 1, line 10, delete the "n" before "The".

Column 2, line 19, insert "arrows" after the word "the".

Column 3, line 44, "provided to" should read -- provided on --.

Signed and Sealed this

Fourteenth Day of March, 1989

*Attest:*

DONALD J. QUIGG

*Attesting Officer*

*Commissioner of Patents and Trademarks*